US006807921B2

(12) United States Patent
Huntsman

(10) Patent No.: US 6,807,921 B2
(45) Date of Patent: Oct. 26, 2004

(54) UNDERWATER VEHICLES

(76) Inventor: Dwight David Huntsman, 14090 Gleneagle Dr., Colorado Springs, CO (US) 80921

( * ) Notice: Subject to any disclaimer, the term of this patent is extended or adjusted under 35 U.S.C. 154(b) by 0 days.

(21) Appl. No.: 10/092,784

(22) Filed: Mar. 7, 2002

(65) Prior Publication Data

US 2003/0167998 A1 Sep. 11, 2003

(51) Int. Cl.[7] ..... B63G 8/00
(52) U.S. Cl. ..... 114/312
(58) Field of Search ..... 114/312, 337

(56) References Cited

U.S. PATENT DOCUMENTS 4,609,362 A * 9/1986 DeMarco ..... 440/75

* cited by examiner

*Primary Examiner*—Jesus D. Sotelo
(74) *Attorney, Agent, or Firm*—Patton Boggs LLP

(57) ABSTRACT

The invention involves underwater vehicles utilizing submersible electricity generation and storage systems involving flywheel devices. These underwater vehicles include autonomous underwater vehicles, remotely operated vehicles, and supporting mobile and stationary tools, stations, and equipment. The underwater vehicle utilizes a pressurizable waterproof enclosure that contains a novel combination of: electricity generation devices, flywheel power sources, energy collection control circuitry and power distribution control circuitry. The underwater vehicle combines these elements to generate and store electricity underwater or at the surface of the water to meet the dynamic electrical requirements of autonomous underwater vehicles, remotely operated vehicles and stationary underwater structures.

36 Claims, 7 Drawing Sheets

UNDERWATER VEHICLES

FIELD OF THE INVENTION

The field of invention involves underwater vehicles (UVs). The field of UVs includes autonomous underwater vehicles (AUVs), remotely operated vehicles (ROVs), and supporting mobile and stationary tools, stations, and equipment.

PROBLEM

Over two-thirds of our world is yet to be explored and this portion of our world is underwater. Even though almost every surface inch of this domain may be accessible, adventures and discoveries to the underwater environment have lagged behind our adventures into space. One of the major hurdles to exploring and operating underwater is the lack of sufficient electricity for the autonomous underwater vehicles (AUV's), remotely operated vehicles (ROV's) and stationary underwater structures.

Electricity has been supplied to remotely operated vehicles and stationary underwater structures through tethers, whose length limits the depth at which a remotely operated vehicle or stationary underwater structure can operate. Further, tethers are cumbersome and can become tangled when more than one remotely operated vehicle is employed. Also, the tether and associated support systems often equal the cost of the remotely operated vehicle. In addition, the ROV and stationary underwater structure can be employed no longer than the surface vessel upon which it relies for electricity. This limits the time that the remotely operated vehicles and stationary underwater structures can be operated. Untethered vehicles, such as autonomous underwater vehicles, are time limited as well based on their ability to generate and store electricity.

Presently, there exists an unmet demand for autonomous underwater vehicles that are capable of operating underwater for extended periods of time independent of physical human intervention. One problem with present autonomous underwater vehicles is their dependence on batteries as the source of their electricity. The use of batteries limits the functional capabilities of the autonomous underwater vehicles by requiring the autonomous underwater vehicle to resurface constantly to exchange or recharge depleted batteries. The power systems employed by today's autonomous underwater vehicles are capable of operating 72 hours or less, before their electrical energy supply is depleted and they are brought back to the surface for recharging or replacement of batteries, which process is time consuming. This significantly limits the usefulness of today's autonomous underwater vehicles, especially in light of the demand for autonomous underwater vehicles to be operational for months at a time.

Stationary underwater structures, which generally receive their electricity from turbines or tethers, are afflicted by the same problem. The use of underwater turbine power generators for generating electricity from water current flow, such as rivers and oceans, is known in the art. Turbines have been used to produce electricity underwater. There are two common types of turbine devices: stationary turbines and tethered turbines. Stationary turbines are comprised of stationary towers based on the ocean floor. Electricity generating turbines are mounted on the towers at a fixed depth, with turbine rotor blades facing the flow of an ocean current. Tethered devices are designed to operate underwater, and are kept in place by a tether that is anchored to the ocean floor.

The electricity generated by these turbine configurations is commonly stored in an array of batteries. Both the stationary and tethered turbines depend on underwater currents to drive the large turbine rotor blades. This limits the possible configurations of vehicle types or platforms that can employ this type of electricity generation. Large underwater turbines are not useful with mobile underwater vehicles such as autonomous underwater vehicles and remotely operated vehicles. Due to the vast array of onboard devices and apparatuses, these vehicles have dynamic electrical power demands and must be capable of maneuvering in tight areas that preclude the use of tethers and bulky turbines.

Electricity for use in underwater systems can also be generated from the use of internal combustion engine generators aboard a surface vessel. The surface vessel then supplies power to a stationary underwater structure or remotely operated vehicles via a tether. These internal combustion engine generators use hydrocarbons as fuel to power the generator. Handling and storing of this hydrocarbon fuel poses a serious environmental threat to the bodies of water where these types of surface vessels and generators are deployed.

One problem associated with present underwater electricity storage systems is the limited capabilities of the present electricity storage designs. Electricity generated by underwater turbines is generally trickled to a battery which can take a significant amount of time to recharge, thereby limiting the capabilities of the system depending upon such a system. If the battery is uncharged, then the vehicle or structure is incapable of functionally operating until the battery is recharged. In addition, if the batteries are to be exchanged for charged batteries, then the autonomous underwater vehicle must surface so that the batteries can be exchanged. Whether the batteries are to be exchanged for charged batteries or recharged from a charging unit, the vehicle must resurface to be serviced accordingly. An underwater system that depends solely on this slow trickle charge and discharge of a battery to supply dynamic electricity demands severely limits the systems found in the prior art.

It would be beneficial and advantageous to have an underwater electricity generation and storage system that was capable of meeting the dynamic demand of underwater electricity requirements, whether they be by a autonomous underwater vehicle, remotely operated vehicle, stationary underwater structure or other underwater apparatus. Further, it would be beneficial and advantageous to have autonomous underwater vehicles, remotely operated vehicles and stationary underwater structures that are capable of efficiently powering themselves under the water for extended periods of time.

SOLUTION

The above and other problems are solved and an advance in the art is made by the underwater vehicle that incorporates a submersible electricity generation and storage system. The underwater vehicle uses a pressurizable waterproof enclosure that contains a novel combination of: electricity generation devices, flywheel power sources, energy collection control circuitry and power distribution control circuitry. The instant application combines these elements to generate and store electricity underwater or at the surface of the water to meet the dynamic electrical requirements of autonomous underwater vehicles, remotely operated vehicles and stationary underwater structures.

Electricity generated by the electricity generating devices is transferred to the energy collection control circuitry. The electricity generating devices are connected to or enclosed within the waterproof enclosure of the system. Electricity transferred to the energy collection control circuitry is then transferred to a flywheel power source. The electricity transferred to a flywheel power source spins up the flywheel power source. Once spun-up, the flywheel power source is a sustained and prolonged supply of electricity to the system's underwater devices. The flywheel power source is capable of being instantly spun-up, thereby eliminating the time-consuming and non-productive activities associated with recharging and replacing batteries. The present submersible electricity generation and storage system is capable of electrically powering an autonomous underwater vehicle, remotely operated vehicle or stationary underwater structure for extended periods of time.

Another problem solved by the present submersible electricity generation and storage system is that an autonomous underwater vehicle, remotely operated vehicle or stationary underwater structure can be instantly recharged by another autonomous underwater vehicle, remotely operated vehicle or stationary underwater structure. The flywheel power source is charged by the onboard electricity generating device part of the system. Further, the flywheel power source is designed to be charged instantly by another autonomous underwater vehicle, remotely operated vehicle or stationary underwater structure. In a preferred embodiment of the present invention, the submersible electricity generating and storage system on board an autonomous underwater vehicle transfers electricity instantly to one another autonomous underwater vehicle underwater or at the water surface, thereby eliminating the need of crews and equipment to service and recharge the autonomous underwater vehicles. The flywheel power source of one autonomous underwater vehicle, remotely operated vehicle or stationary underwater structure transfers electricity to an electrical apparatus onboard the other autonomous underwater vehicle, remotely operated vehicle or stationary underwater structure.

The submersible electricity generating and storage system can be sized or designed according to the use and electricity requirements of the structure or vehicle. Stationary underwater structures can have system sizes and designs that are commensurate with their electricity requirements. This can include larger rotor turbines and a great number of flywheel power sources. Conversely, autonomous underwater vehicles and remotely operated vehicles which are generally smaller and mobile, can have systems that are appropriately designed to fit within their waterproof bodies.

DESCRIPTION OF THE DRAWINGS

The above and other features of present invention can be better understood from a reading of the detailed description and the following drawings.

DETAILED DESCRIPTION

Submersible Electricity Generation and Storage System

Figure 1:
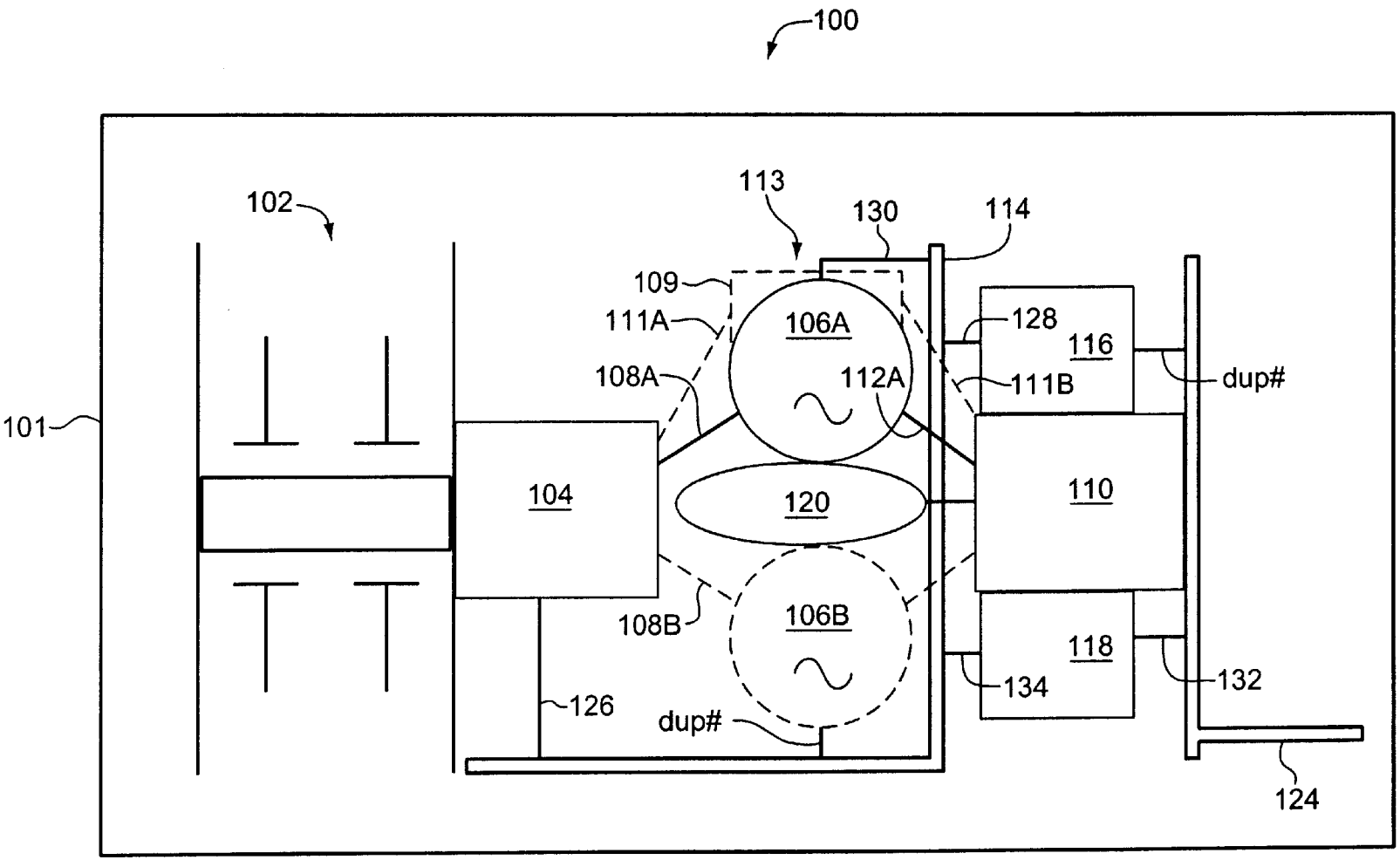
FIG. 1 illustrates an enlarged diagram of a preferred exemplary embodiment of a submersible electricity generation and storage system.
Figure 2:
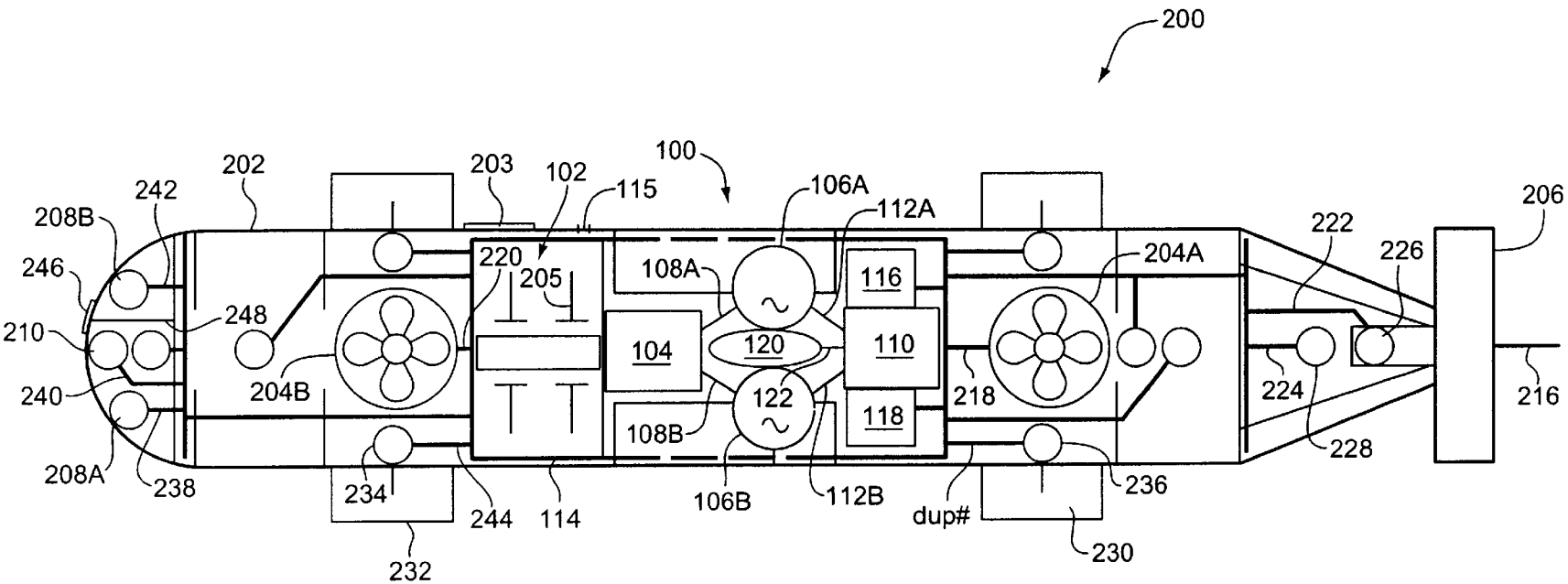
FIG. 2 illustrates a diagram of a preferred exemplary embodiment of a submersible electricity generation and storage system in an autonomous underwater vehicle.

FIG. 1 illustrates a submersible electricity generation and storage system 100 and FIG. 2 illustrates the submersible electricity generation and storage system 100 as it is used in an autonomous underwater vehicle 200. The submersible electricity generation and storage system 100 in FIG. 1 is shown in an enlarged view and not incorporated in any particular vehicle. Waterproof enclosure 101 contains the submersible electricity generation and storage system 100. The enclosure 101 is a rigid or semi-rigid shell that is waterproof. The enclosure 101 is the shell 202 of the autonomous underwater vehicle in FIG. 2. The enclosure 101 is the waterproof enclosure 302 in FIG. 3. The enclosure 101 can be any waterproof enclosure common to those skilled in the art. For purposes of description, the submersible electricity generation and storage system 100 described in FIG. 1, is being described without any incorporation into a mobile vehicle or stationary underwater structure. The submersible electricity generation and storage system 100 contains an electricity generating device (EGD) 102. The electricity generating device 102 can be one device or an array of devices, depending on the environment where the autonomous underwater vehicle 200 is employed and include but are not limited to: acoustico devices, cathodic potential devices, electrochemical devices, electrostatic devices, flexogelectric devices, ionic polymer gel devices, photovoltaic devices, piezocapacitors, piezocrystals, piezoelectric devices, piezomagnetic devices, piezoresistors, piezovoltaic devices, and thermocoupling devices. These devices are commonly known by those skilled in the art.

In one embodiment of the submersible electricity generation and storage system, the electricity is generated by subjecting piezoelectrics to pressure, such as underwater pressure. In another embodiment using piezoelectrics, the piezoelectrics are subjected to compression/decompression pressures by the force of water on the autonomous underwater vehicle 200. In this embodiment, one location of the piezoelectrics is on the outside of the shell of the autonomous underwater vehicle, whereby the force of the water applies pressure against the piezoelectrics located on the outside of the shell. Another location of the piezoelectrics is on the inside of the shell, whereby the shell is slightly collapsible allowing for the outside water pressure to slightly collapse the shell and thereby applying pressure against the piezoelectrics located within the shell of the autonomous underwater vehicle. Another location of the piezoelectrics is on the inside of the shell, whereby outside water is allowed to come in contact with the piezoelectrics through channels in the shell, thereby applying pressure against the piezoelectrics located within the shell of the autonomous underwater vehicle.

In another embodiment using piezoelectrics, the piezoelectrics are subjected to compression/decompression pressure by an acoustic or pressure pulse generator. In this embodiment, the piezoelectrics are subjected to cycling pressures created by an acoustic or pressure pulse generator.

In another embodiment using piezoelectrics, the piezoelectrics are subjected to constant compression pressure by the force of water proximate to the autonomous underwater vehicle 200. In this embodiment, the location of the piezoelectrics are located on the outside of the shell. In this embodiment, the piezoelectrics are located on the inside of the shell.

In another embodiment of the submersible electricity generation and storage system, electricity is generated by the use of thermocouplers that are in contact with differing temperature objects, such as the cold body of the autonomous underwater vehicle 200 and a source of heat within the autonomous underwater vehicle 200. In another embodiment of the submersible electricity generation and storage system, electricity is generated by the use of acoustic pulse generators. In another embodiment of the submersible electricity generation and storage system, electricity is generated by electrochemical reactions and electrostatic reactions. There are numerous technologies that can be used to implement the electricity generating devices and these include tensile stress, shearing stress and compressive stress technologies, in addition to electrochemical, photovoltaic, electrostatic and hydrostatic technologies. These concepts are well known in the field of electricity generation and various ones of these or combinations of these can be used to implement the electricity generation function of the submersible electricity generation and storage system. These technologies are not limitations to the system which is described herein, since a novel system concept is disclosed, not a specific technologically limited implementation of an existing system concept.

Energy collection control circuitry (ECCC) 104 is a collection of electricity storage devices that are common to those skilled in the art. In a preferred embodiment of the submersible electricity generation and storage system, an array of capacitors is used to temporarily store electricity generated by the electricity generating device 102. First flywheel power source 106A is a flywheel that is quickly spun-up by an electrical charge supplied from the energy collection control circuitry 104. Once spun-up to its designed revolutions, the flywheel serves the function of generating electricity for the system. The flywheel power source is commonly known to those skilled in the art. Among these flywheel power sources commonly known to those skilled in the art are carbon fiber composite flywheels, which allow it to achieve extraordinary power density due to carbon fiber's high stress tolerance and low density. Inside the rotor is a dipole motor generator that absorbs and delivers power on demand. The rotor spins at speeds up to 40,000 rpm inside a vacuum enclosure. The flywheel uses both advanced magnetic bearings and custom-designed mechanical bearings to reduce friction.

FIG. 1 shows first flywheel power source 106A and a second flywheel power source 106B. The second flywheel power source 106B is shown in dotted lines to indicate that it is an additional and optional flywheel power source. The submersible electricity generation and storage system 100 is capable of containing one or numerous flywheel power sources, depending on the use and needs of the submersible electricity generation and storage system 100. Although FIG. 1 shows two flywheel power sources, 106A and 106B, the submersible electricity generation and storage system 100 is not limited by the use of two flywheel power sources and it should be understood that any number of flywheel power sources may be employed depending on the nature of the vehicle's function. In one embodiment of the submersible electricity generation and storage system 100, one flywheel power source is spun up at one time. In another embodiment, more than one flywheel power sources are spun up at one time. In another embodiment, one flywheel power source is spun up while another flywheel power source is static.

First flywheel power source 106A is connected to energy collection control circuitry 104 via first energy collection control circuitry pathway 108A. Second flywheel power source 106B is connected to energy collection control circuitry 104 via second energy collection control circuitry pathway 108B. As noted above, the dotted lines representing energy collection control pathway 108B show an optional pathway for electricity in the case where a second flywheel power source 106B is employed. The electricity generated by the first flywheel power source 106A is sent to the power distribution control circuitry (PDCC) 110 via first power distribution control circuitry pathway 112A. The electricity generated by the second flywheel power source 106B is sent to the power distribution control circuitry 110 via second power distribution control circuitry pathway 112B, which is shown by a dotted line to reflect that it is an optional pathway. First flywheel power source 106A is connected to the communications bus 114 via first flywheel communications pathway 130 and second flywheel power source 106B is connected to the communications bus 114 via second flywheel communications pathway 128.

A bypass circuit 113 is used to optionally store electricity generated by the energy collection control circuitry 104. The bypass circuit 113 can be used in concurrence with first flywheel power source 106A or bypass circuit 113 can be used in place of first flywheel power source 106A. The bypass circuit 113 comprises a bypass storage device 109 that is connected to the energy collection control circuitry 104 via first bypass circuit pathway 111A. The electricity stored by the bypass storage device 109 is sent to the power distribution control circuitry 110 via second bypass circuit pathway 111B. The bypass storage device 109 is commonly known to those skilled in the art. These bypass storage devices 109 include but are not limited to batteries and other commonly known electrical storage devices.

The power distribution control circuitry 110 distributes the electricity as it is required by the autonomous underwater vehicle 200 through the power bus 124. The submersible electricity generation and storage system 100 also includes a local mass storage memory 118 for storing control instructions for use by processor 116 as well as data and communication instructions as mentioned below. Processor 116 is connected to the communication bus 114 via processor communication pathway 128. Processor 116 is also connected to the power bus 124 via processor power pathway 130. Local mass storage memory 118 is connected to the communication bus 114 via local mass storage communication pathway 134. Local mass storage memory 118 is connected to the power bus 124 via local mass storage memory power pathway 132. Communications device 120 is connected to power distribution control circuitry 110 via communications pathway 122. Energy collection control circuitry 104 is connected to communications bus 114 via energy collection control circuitry communications pathway 126.

An Overview of the Submersible Electricity Generation and Storage System in an Autonomous Underwater Vehicle FIG. 2 illustrates the submersible electricity generation and storage system in an autonomous underwater vehicle 200. In FIG. 2 the waterproof shell 202 is the shell of the autonomous underwater vehicle 200. In one embodiment of the autonomous underwater vehicle 200, the electricity generating device 102 is an array of outside piezoelectrics 203 and is located on the outside of the shell 202 of the autonomous underwater vehicle 200. The array of outside piezoelectrics 203 covers as much of the shell 202 as is necessary to generate sufficient electricity for the autonomous underwater vehicle 200. In another embodiment of the autonomous underwater vehicle 200, the electricity generating device 102 is an array of inside piezoelectrics 205 located within the shell 202 of the autonomous underwater vehicle 200. In this configuration, the shell is semi-rigid to allow the external pressure of the water to slightly collapse the shell 202 creating pressure on the array of inside piezoelectrics 205, thereby generating electricity for the autonomous underwater vehicle 200. In another embodiment of the autonomous underwater vehicle 200, the electricity generating device 102 is an array of inside piezoelectrics 205 located within the shell 202 and the shell has a channel 115 that allows water inside the body of the shell 202 and applies pressure against the array of inside piezoelectrics 205. Autonomous underwater vehicle 200 includes a propulsion device 204A which is electrically connected to power bus 114 via first propulsion device pathway 218. In another embodiment of the autonomous underwater vehicle 200, the propulsion devices may be more than one. FIG. 2 shows a second propulsion device 204B which is electrically connected to the power bus 114 via second propulsion device pathway 220. A propeller 206 is powered by pro peller motor 228 which is electrically connected to power bus 114 via propeller motor pathway 222. Rudder 216 is powered by rudder motor 226 which is electrically connected to power bus 114 via rudder motor pathway 222. The number and location of propulsion devices are well known in the field of underwater propulsion and various ones of these or combinations of these can be used to implement the propulsion function of the autonomous underwater vehicle 200. The number and location of the propulsion devices are not limitations to the system which is described herein, since a novel submersible electricity generation and storage system 100 is disclosed, not a specific technologically limited implementation of an existing system concept.

The autonomous underwater vehicle 200 utilizes non-propulsion submersible devices. FIG. 2 illustrates several non-propulsion submersible devices such as a first light 208A, a second light 208B and a camera 210 that are electrically connected to power bus 114 via first light pathway 238, second light pathway 242 and camera pathway 240, respectively. This is not a limiting embodiment, as there may be any number of non-propulsion submersible devices employed on an autonomous underwater vehicle. These non-propulsion submersible devices include but are not limited to: cameras, lights, sensors, sonars, profilers, pingers, repeaters, transducers, transponders, magnetometers, potentiometers, radars, temperature devices, depth sensors, side-scan sonars, multi-beam sonars, sub-bottom profilers, temperature sensors, moisture sensors, light sensors, manipulators, global positioning satellite devices, collision detection sonar, inertial navigation devices, navigation equipment, communication equipment, docking devices and special tooling. Further, mechanical arms and sensors (not shown) may also be employed to expand the functionality of the autonomous underwater vehicle. These non-propulsion submersible devices can be located inside or outside the body of the autonomous underwater vehicle 200 and are connected to power bus 114. In the same embodiment as shown in FIG. 2, dive control plane 232 is powered by dive control plane motor 234 which is electrically connected to power bus 114 via dive control plane motor pathway 244. Stabilizer control plane 230 is powered by stabilizer control plane motor 236 which is electrically connected to power bus 114 via stabilizer control plane motor pathway 246.

The body 202 has a docking device 246 that enables one autonomous underwater vehicle 200 to dock with another autonomous underwater vehicle 200 for the purposes of transferring power and data between the autonomous underwater vehicles while in or out of a body of water. Docking device 246 is electrically connected to power bus 114 via docking device pathway 248. The docking devices 246 are commonly available to those skilled in the art.

Figure 3:
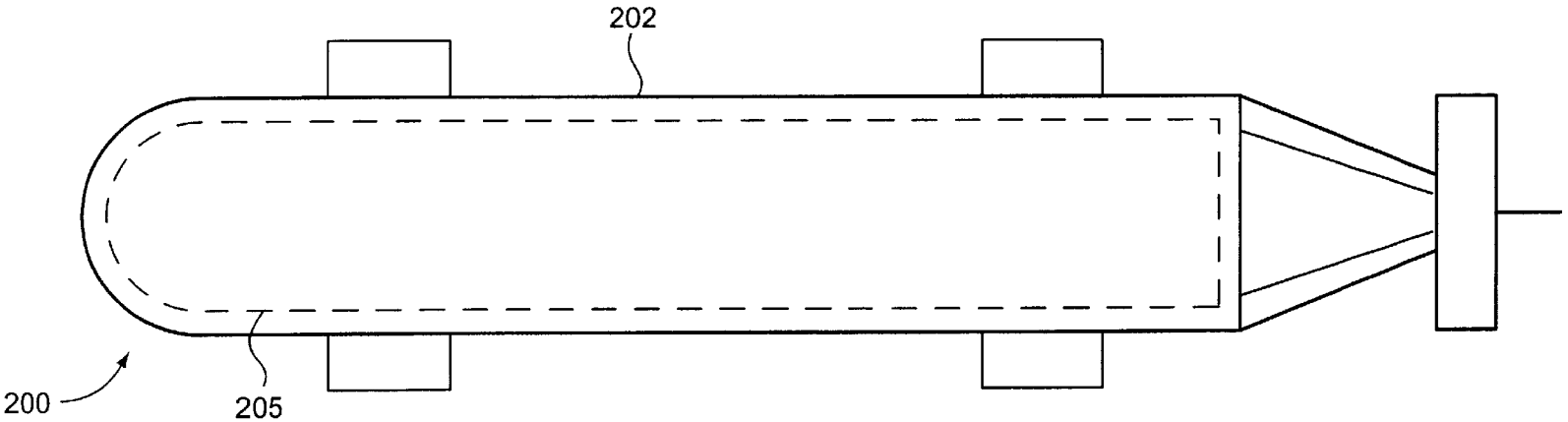
FIG. 3 illustrates a diagram of a autonomous underwater vehicle with an electricity generating device located within the shell of the autonomous underwater vehicle.
Figure 3A:
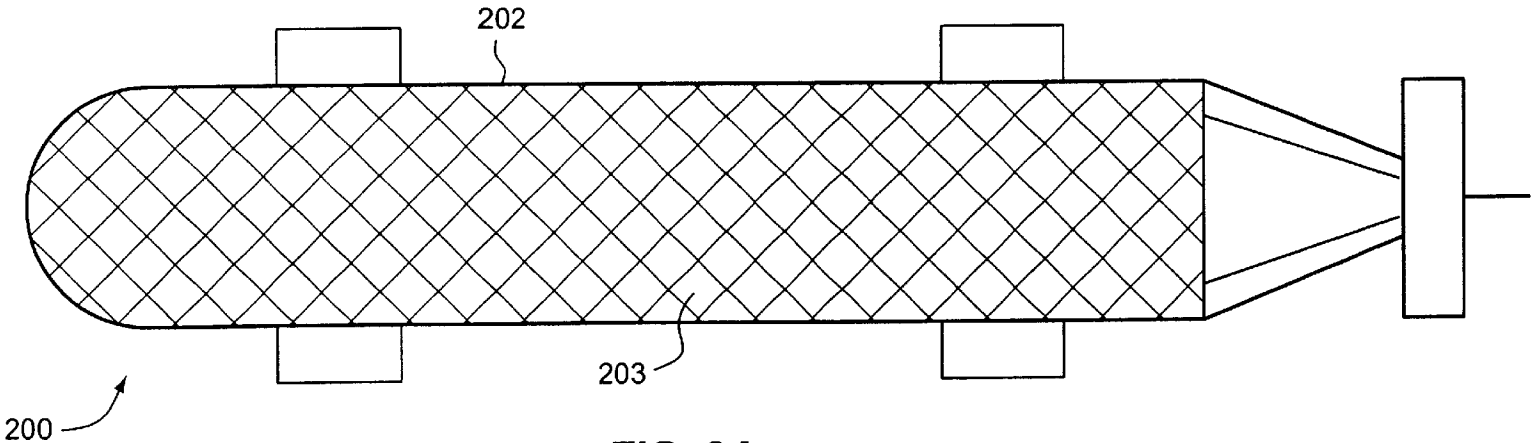
FIG. 3A illustrates a diagram of a autonomous underwater vehicle with an electricity generating device located outside the shell of the autonomous underwater vehicle.

FIG. 3 illustrates an embodiment of the autonomous underwater vehicle 200 with an electricity generating device 102 such as an array of inside piezoelectrics 205 located within the shell 202 of the autonomous underwater vehicle 200. FIG. 3A illustrates an embodiment of the autonomous underwater vehicle 200 with an electricity generating device array such as an array of outside piezoelectrics 203 oriented on the outside of the autonomous underwater vehicle 200. These are two different arrangements of the electricity generating device 102, but various other arrangements could be employed in the autonomous underwater vehicle 200. Other electricity generating devices employed in the autonomous underwater vehicle include: acoustics devices, cathodic potential devices, electrochemical devices, electrostatic devices, flexogelectric devices, ionic polymer gel devices, photovoltaic devices, piezocapacitors, piezocrystals, piezoelectric devices, piezomagnetic devices, piezoresistors, piezovoltaic devices, and thermocoupling devices.

Figure 4:
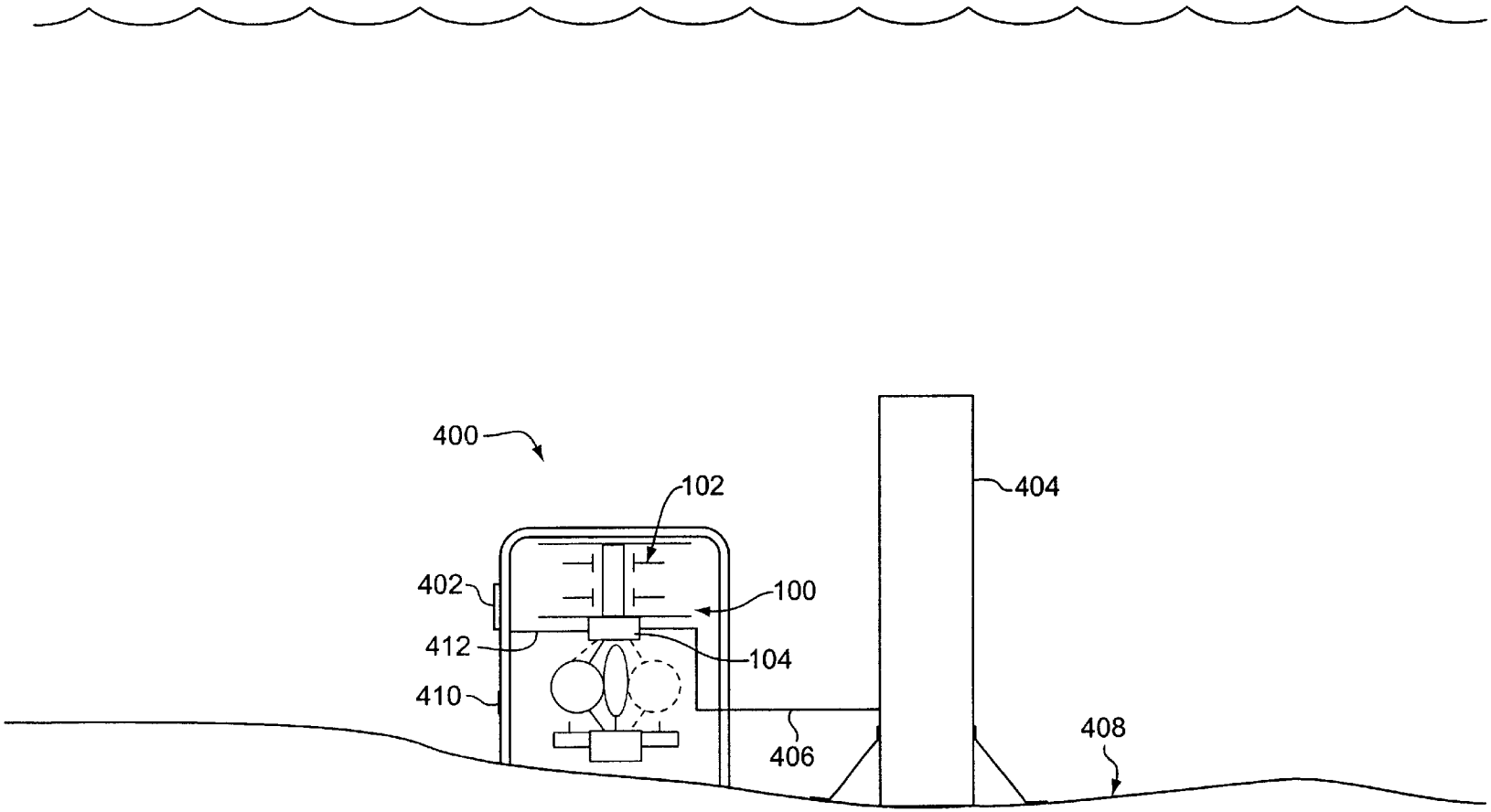
FIG. 4 illustrates a diagram of a submersible electricity generation and storage system in a stationary structure.

FIG. 4 illustrates a stationary underwater structure 400 with a fixed turbine 404 anchored to the bottom of the body of water 408 to generate electricity. Fixed turbine 404 is electrically connected to energy collection control circuitry 104 via turbine pathway 406. In another embodiment of the stationary underwater structure 400, an array of electricity generation devices 102, such as outside piezoelectrics 410, are also located on the outside of the stationary underwater structure 400 and are electrically connected to the energy collection control circuitry 104 via pathway 412. In another embodiment of the stationary underwater structure 400, an array of electricity generation devices 102 are also located on the inside of stationary underwater structure 400. Other electricity generating devices employed in the stationary underwater structure include: acoustico devices, cathodic potential devices, electrochemical devices, electrostatic devices, flexogelectric devices, ionic polymer gel devices, photovoltaic devices, piezocapacitors, piezocrystals, piezoelectric devices, piezomagnetic devices, piezoresistors, piezovoltaic devices, and thermocoupling devices.

Figure 5:
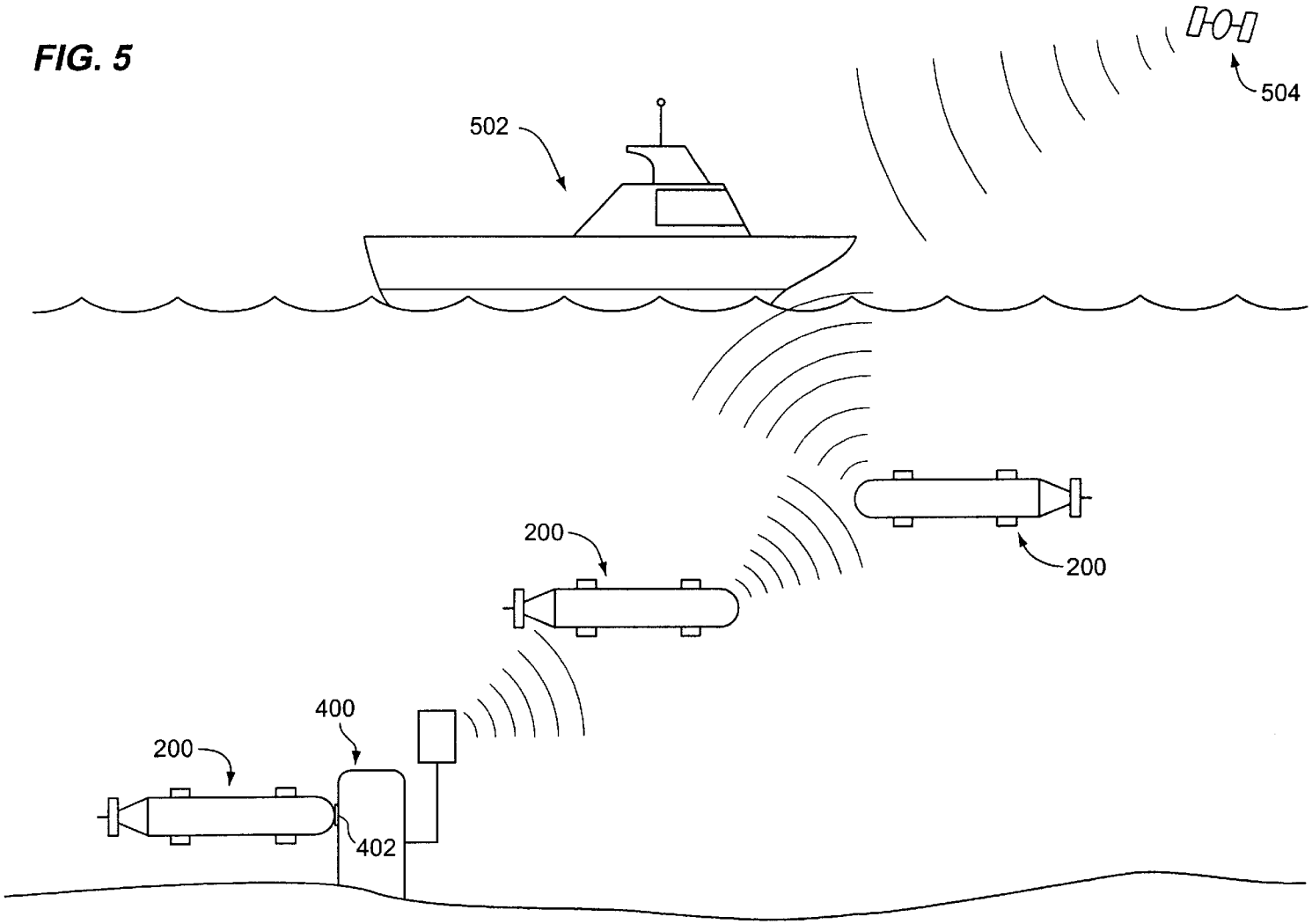
FIG. 5 illustrates a diagram of a preferred exemplary embodiment of a submersible electricity generation and storage system in an array of autonomous underwater vehicles and a stationary structure.

FIG. 5 illustrates a fleet of autonomous underwater vehicles 200 employed in the vicinity of a stationary underwater structure 400. Surface vessel 502 assists communicating data transmissions from the autonomous underwater vehicles and the stationary structures below to other points such as satellite 504. Autonomous underwater vehicles 200 are shown communicating to each other through wireless technology commonly known to those skilled in the art. Further, in another embodiment of the autonomous underwater vehicle 200, the docking device 246 of the autonomous underwater vehicle docks with a stationary underwater structure docking device 402 to transfer power between the stationary underwater structure 400 and the autonomous underwater vehicle 200.

Figure 6B:
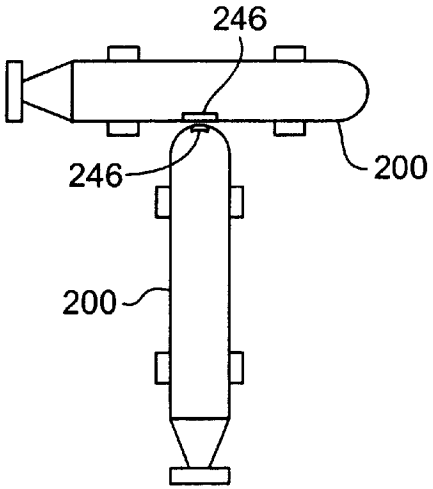
FIG. 6B illustrates a diagram of a preferred exemplary embodiment of a submersible electricity generation and storage system used in an orthogonal docking situation involving two autonomous underwater vehicles.
Figure 6C:
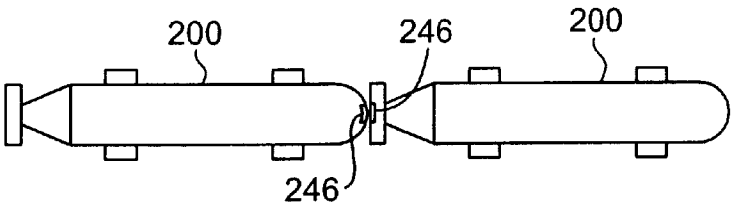
FIG. 6C illustrates a diagram of a preferred exemplary embodiment of a submersible electricity generation and storage system used in a sequential docking situation involving two autonomous underwater vehicles.
Figure 6:
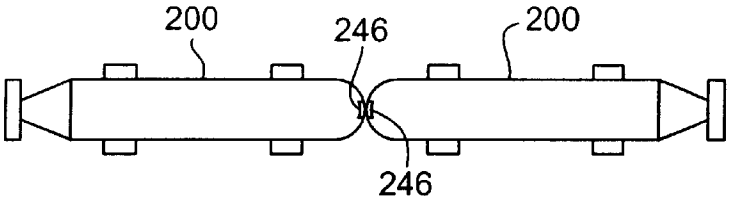
FIG. 6 illustrates a diagram of a preferred exemplary embodiment of a submersible electricity generation and storage system used in a docking situation involving two autonomous underwater vehicles.
Figure 6A:
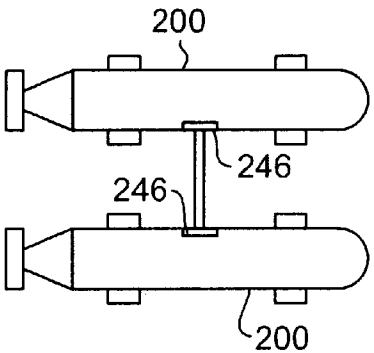
FIG. 6A illustrates a diagram of a preferred exemplary embodiment of a submersible electricity generation and storage system used in a parallel docking situation involving two autonomous underwater vehicles.

FIG. 6 illustrates two autonomous underwater vehicles 200 docking each other. During a docking sequence autonomous underwater vehicles 200 transfer power or energy, electrical or otherwise to one another. The docking sequences are also designed to be performed between autonomous underwater vehicles and remotely operated vehicles. Further the docking sequences are also designed to be performed between autonomous underwater vehicles and stationary underwater structures. In this FIG. 6 docking sequence, the energy transfer is uni-directional or bi-directional. FIG. 6 shows two autonomous underwater vehicles 200 with docking device 246 located in the nose section of the autonomous underwater vehicles 200. FIG. 6A, shows another configuration of the docking sequence, specifically, where two autonomous underwater vehicles 200 are docking side by side. The autonomous underwater vehicles 200 have a docking device 246 located on the side of their respective shells. FIG. 6B shows another configuration of the docking sequence, specifically, where the docking device 246 is located on the side of one autonomous underwater vehicle 200 and on the nose section of the other autonomous underwater vehicle 200. FIG. 6C shows another configuration of the docking sequence, specifically, where the docking device 246 is located on the nose section of one autonomous underwater vehicle 200 and on the aft section of the other autonomous underwater vehicle 200. The docking device 200 allows the uni-directional or bi-directional transfer of electrical or mechanical energy from one autonomous underwater vehicle 200 to another autonomous underwater vehicle 200. The number and location of the docking devices are not limitations to the system which is described herein, since a novel submersible electricity generation and storage system 100 is disclosed, not a specific technologically limited implementation of an existing system concept.

Figure 7:
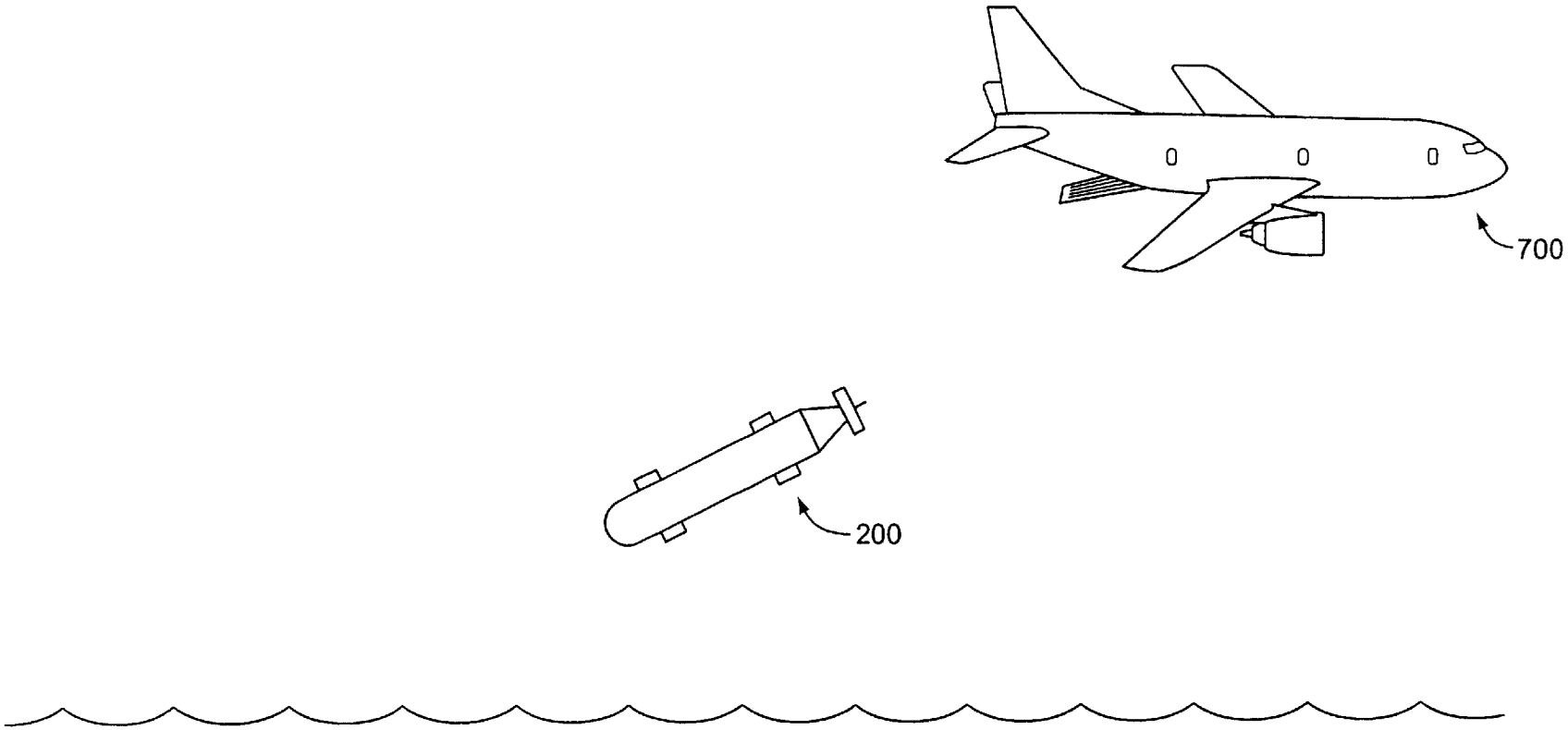
FIG. 7 illustrates a diagram of a preferred exemplary embodiment of a submersible electricity generation and storage system in an autonomous underwater vehicle that is being deployed by an aircraft.

Due to the autonomous nature of the autonomous underwater vehicle 200, it can be deployed by submarines, surface vessels, land vehicles, booms, stingers and by aircraft as shown in FIG. 7. FIG. 7 illustrates an airdrop deployment of an autonomous underwater vehicle 200 by an aircraft 700

SUMMARY

The submersible electricity generation and storage system provides a power source for a self-contained underwater vehicle comprising: a pressurizable waterproof body, at least one electricity generation device located outside the body, an energy collection control circuitry located inside the body and an at least one flywheel power source located inside the body, the energy collection control circuitry communicating between the electricity generation device and the flywheel power source for transferring electricity between the electricity generation device and the flywheel power source; and a power distribution control circuitry located inside the body and an at least one propulsion device located outside the body, the power distribution control circuitry connected between the flywheel power source and the propulsion device for transferring electricity between the flywheel power source and the propulsion device.

Although there has been described what is at present considered to be the preferred embodiments of the present invention, it will be understood that the invention can be embodied in other specific forms without departing from the spirit or essential characteristics thereof. The present embodiments are, therefore, to be considered in all aspects as illustrative and not restrictive. The scope of the invention is indicated by the appended claims rather that the foregoing description.

What is claimed is:

1. A self-contained underwater vehicle, said vehicle comprising:

a pressurizable waterproof body;

at least one electricity generation device located outside said body;

at least one flywheel power source located inside said body;

energy collection control circuitry located inside said body, the energy collection control circuitry communicating between said electricity generation device and said flywheel power source for transferring electricity between said electricity generation device and said flywheel power source;

at least one propulsion device; and a power distribution control circuitry located inside said body said power distribution control circuitry connected between said flywheel power source and said propulsion device for transferring electricity between said flywheel power source and said propulsion device.

2. The self-contained underwater vehicle of claim 1, further comprising at least one electricity generating device is located inside said body.

3. The self-contained underwater vehicle of claim 1, further comprising:

at least one communications device located inside said body, to transmit and receive data.

4. The self-contained underwater vehicle of claim 1, further comprising:

at least one processor located inside said body, wherein said processor is connected between said flywheel power source and said energy collection control circuitry to monitor and direct flywheel activity.

5. The self-contained underwater vehicle of claim 1, further comprising:

at least one submersible non-propulsion device affixed to said body.

6. The self-contained underwater vehicle of claim 5, wherein said non-propulsion submersible device is selected from the group consisting of: cameras, lights, sensors, sonars, profilers, pingers, repeaters, transducers, transponders, magnetometers, cathodic potentiometers, radars, temperature devices, depth sensors, side-scan sonars, multi-beam sonars, sub-bottom profilers, temperature sensors, moisture sensors, light sensors, manipulators, global positioning satellite devices, collision detection sonar, inertial navigation devices, navigation equipment, communication equipment, dive control planes, rudders, and docking devices.

7. The self-contained underwater vehicle of claim 1, further comprising:

a bypass circuit located inside said body, wherein said bypass circuit communicates with said energy collection control circuitry and said power distribution control circuitry.

8. The self-contained underwater vehicle of claim 7, wherein said bypass circuit comprises a bypass storage device.

9. The self-contained underwater vehicle of claim 1, further comprising:

a docking device located outside of said body, wherein said docking device is electrically connected to said flywheel power source.

10. The self-contained underwater vehicle of claim 1, wherein said electricity generation device is selected from the group consisting of: acoustico devices, cathodic potential devices, electrochemical devices, electrostatic devices, flexogelectric devices, ionic polymer gel devices, photovoltaic devices, piezocapacitors, piezocrystals, piezoelectric devices, piezomagnetic devices, piezoresistors, piezovoltaic devices, and thermocoupling devices.

11. The self-contained underwater vehicle of claim 1, wherein said propulsion device is selected from the group consisting of: thrusters, stabilizers, propellers, mechanical devices, and electrical motors.

12. An underwater vehicle having a waterproof and pressurizable body for self-containment comprising:

means for generating electricity located outside said body;

at least one flywheel power source located inside said body;

means for energy collection located inside said body, the energy collection means connected between said electricity generation means and said flywheel power source for transferring electricity between said electricity generation means and said flywheel power source; and means for power distribution located inside said body and a motive means located outside said body, said power distribution means connected between said flywheel power source and said motive means for transferring electricity between said flywheel power source and said motive means.

13. The underwater vehicle of claim 12, further comprising means for generating electricity located inside said body.

14. The underwater vehicle of claim 12, further comprising:

means for communication, said communication means located inside said body to transmit and receive data.

15. The underwater vehicle of claim 14, further comprising:

at least one processor located inside said body, wherein said processor is connected to said power distribution means and said communication means.

16. The underwater vehicle of claim 12, further comprising:

second means for storing electricity generated by said electricity generation means located inside said body.

17. The vehicle of claim 12, further comprising:

means for communication located inside said body, wherein the communication means transmits and receives data between said vehicle and a desired communications device outside said body.

18. The submersible underwater vessel of claim 17, further comprising at least one electricity generating device located inside said body.

19. A submersible underwater vessel capable of generating and storing electricity, said vessel comprising:

a pressurizable waterproof body;

at least one electricity generation device located outside said body;

at least one flywheel power source located inside said body;

an energy collection control circuitry located inside said body, the energy collection control circuitry communicating between said electricity generation device and said flywheel power source for transferring electricity between said electricity generation device and said flywheel power source;

at least one propulsion device;

a power distribution control circuitry located inside said body, said power distribution control circuitry connected between said flywheel power source and said propulsion device for transferring electricity between said flywheel power source and said propulsion device;

at least one communications device located inside said body, to transmit and receive data, and at least one processor located inside said body, wherein said processor is connected between said flywheel power source and said energy collection control circuitry to monitor and direct flywheel activity.

20. The submersible underwater vessel of claim 19, further comprising an at least one submersible non-propulsion device affixed to said body.

21. The submersible underwater vessel of claim 20, wherein said non-propulsion submersible device is selected from the group consisting of: cameras, lights, sensors, sonars, profilers, pingers, repeaters, transducers, transponders, magnetometers, cathodic potentiometers, radars, temperature devices, depth sensors, side-scan sonars, multi-beam sonar, sub-bottom profilers, temperature sensors, moisture sensors, light sensors, manipulators, global positioning satellite devices, collision detection sonar, inertial navigation devices, navigation equipment, communication equipment, dive control planes, rudders, and docking devices.

22. The submersible underwater vessel of claim 19, further comprising:

a bypass circuit located inside said body, wherein said bypass circuit communicates with said energy collection control circuitry and said power distribution control circuitry.

23. The submersible underwater vessel of claim 22, wherein said bypass circuit comprises a bypass storage device.

24. The submersible underwater vessel of claim 19, further comprising:

a docking device located outside of said body, wherein said docking device is electrically connected to said flywheel power source.

25. The submersible underwater vessel of claim 19, wherein said electricity generation device is selected from the group consisting of: acoustico devices, cathodic potential devices, electrochemical devices, electrostatic devices, flexogelectric devices, ionic polymer gel devices, photovoltaic devices, piezocapacitors, piezocrystals, piezoelectric devices, piezomagnetic devices, piezoresistors, piezovoltaic devices, and thermocoupling devices.

26. The submersible underwater vessel of claim 19, wherein said propulsion device is selected from the group consisting of: thrusters, stabilizers, propellers, mechanical devices, and electrical motors.

27. A self-contained underwater vehicle, said vehicle comprising:

a pressurizable waterproof body;

at least one electricity generation device located inside said body;

at least one flywheel power source located inside said body;

energy collection control circuitry located inside said body, the energy collection control circuitry communicating between said electricity generation device and said flywheel power source for transferring electricity between said electricity generation device and said flywheel power source;

at least one propulsion device; and a power distribution control circuitry located inside said body said power distribution control circuitry connected between said flywheel power source and said propulsion device for transferring electricity between said flywheel power source and said propulsion device.

28. The self-contained underwater vehicle of claim 27, further comprising:

at least one communications device located inside said body, to transmit and receive data.

29. The self-contained underwater vehicle of claim 27, further comprising:

at least one processor located inside said body, wherein said processor is connected between said flywheel power source and said energy collection control circuitry to monitor and direct flywheel activity.

30. The self-contained underwater vehicle of claim 27, further comprising:

at least one submersible non-propulsion device affixed to said body.

31. The self-contained underwater vehicle of claim 30, wherein said non-propulsion submersible device is selected from the group consisting of: cameras, lights, sensors, sonars, profilers, pingers, repeaters, transducers, transponders, magnetometers, cathodic potentiometers, radars, temperature devices, depth sensors, side-scan sonars, multi-beam sonars, sub-bottom profilers, temperature sensors, moisture sensors, light sensors, manipulators, global positioning satellite devices, collision detection sonar, inertial navigation devices, navigation equipment, communication equipment, dive control planes, rudders, and docking devices.

32. The self-contained underwater vehicle of claim 27, further comprising:

a bypass circuit located inside said body, wherein said bypass circuit communicates with said energy collection control circuitry and said power distribution control circuitry.

33. The self-contained underwater vehicle of claim 32, wherein said bypass circuit comprises a bypass storage device.

34. The self-contained underwater vehicle of claim 27, further comprising:

a docking device located outside of said body, wherein said docking device is electrically connected to said flywheel power source.

35. The self-contained underwater vehicle of claim 27, wherein said electricity generation device is selected from the group consisting of: acoustico devices, cathodic potential devices, electrochemical devices, electrostatic devices, flexogelectric devices, ionic polymer gel devices, photovoltaic devices, piezocapacitors, piezocrystals, piezoelectric devices, piezomagnetic devices, piezoresistors, piezovoltaic devices, and thermocoupling devices.

36. The self-contained underwater vehicle of claim 27, wherein said propulsion device is selected from the group consisting of: thrusters, stabilizers, propellers, mechanical devices, and electrical motors.

* * * * *

UNITED STATES PATENT AND TRADEMARK OFFICE

CERTIFICATE OF CORRECTION

PATENT NO. : 6,807,921 B2
DATED : October 26, 2004
INVENTOR(S) : Huntsman

It is certified that error appears in the above-identified patent and that said Letters Patent is hereby corrected as shown below:

Title page,
Item [76], Inventor, delete "Dwight David Huntsman, 14090 Gleneagle Dr., Colorado Springs, CO (US) 80921" and insert -- Dwight David Huntsman, 17011 Lincoln Ave., #474, Parker, CO (US) 80134 --

Signed and Sealed this

Ninth Day of August, 2005

JON W. DUDAS
*Director of the United States Patent and Trademark Office*